US007874970B2

(12) United States Patent
Glisan

(10) Patent No.: US 7,874,970 B2
(45) Date of Patent: Jan. 25, 2011

(54) POWER-CORE TRAINING SYSTEM

(76) Inventor: Billy J. Glisan, 1613 Redberry Ct., Fort Collins, CO (US) 80525

( * ) Notice: Subject to any disclaimer, the term of this patent is extended or adjusted under 35 U.S.C. 154(b) by 0 days.

(21) Appl. No.: 12/164,227

(22) Filed: Jun. 30, 2008

(65) Prior Publication Data

US 2009/0011909 A1 Jan. 8, 2009

Related U.S. Application Data

(60) Provisional application No. 60/947,516, filed on Jul. 2, 2007.

(51) Int. Cl.
*A63B 21/02* (2006.01)

(52) U.S. Cl. ..... 482/124

(58) Field of Classification Search ..... 482/121, 482/124–126, 69
See application file for complete search history.

(56) References Cited

U.S. PATENT DOCUMENTS

| | | | | |
|---|---|---|---|---|
| 1,561,960 | A | 11/1925 | Ungar | |
| 1,703,375 | A | 2/1929 | Volk | |
| 3,870,317 | A | 3/1975 | Wilson | |
| 4,544,155 | A | 10/1985 | Wallenbrock et al. | |
| 4,593,909 | A | 6/1986 | Anselmo et al. | |
| 5,048,836 | A | 9/1991 | Bellagamba | |
| 5,050,885 | A | 9/1991 | Ballard et al. | |
| 5,080,191 | A * | 1/1992 | Sanchez | 182/3 |
| 5,186,701 | A * | 2/1993 | Wilkinson | 482/125 |
| 5,188,366 | A | 2/1993 | Dorotinsky et al. | |
| 5,209,482 | A | 5/1993 | Hopfer | |
| 5,308,074 | A | 5/1994 | Dorotinsky et al. | |
| 5,358,250 | A | 10/1994 | Spencer | |
| 5,647,827 | A * | 7/1997 | Gutkowski et al. | 482/124 |
| 5,820,533 | A * | 10/1998 | Goldman | 482/124 |
| 5,924,933 | A | 7/1999 | Pacheco | |
| 5,984,797 | A | 11/1999 | Kessler et al. | |
| 6,120,418 | A | 9/2000 | Plough | |
| 6,213,922 | B1 * | 4/2001 | Afanasenko et al. | 482/124 |
| 6,287,242 | B1 * | 9/2001 | Fray | 482/121 |
| 6,503,148 | B2 | 1/2003 | Lane | |
| 6,551,196 | B1 | 4/2003 | Kossnar et al. | |
| 7,153,246 | B2 * | 12/2006 | Koscielny et al. | 482/121 |
| 2003/0092545 | A1 * | 5/2003 | Koscielny et al. | 482/124 |
| 2007/0004570 | A1 * | 1/2007 | Afanasenko et al. | 482/124 |
| 2007/0015640 | A1 * | 1/2007 | Demeniuk | 482/124 |
| 2007/0135279 | A1 * | 6/2007 | Purdy et al. | 482/124 |

* cited by examiner

*Primary Examiner*—Fenn C Mathew
(74) *Attorney, Agent, or Firm*—Ancel W. Lewis, Jr.

(57) ABSTRACT

A rotational sports training and conditioning system has a hip harness, a torso harness, a pair of adjustable connectors that connect diagonally from the torso harness to the hip harness, an elongated cord and a club band. The hip and torso harnesses each have selectively positioned cord loops for attachment of the cord and/or the club band. The connectors selectively synchronize relative rotation of the pelvis and torso for swing, strike or throw training and conditioning. The cord assists or resists rotational motions. The club band synchronizes arm positioning and forearm rotation with rotation of the pelvis and upper torso.

14 Claims, 6 Drawing Sheets

POWER-CORE TRAINING SYSTEM

This application claims the benefit under 35 U.S.C. §119 (e) of the U.S. provisional patent application No. 60/947,516 filed Jul. 2, 2007, for the disclosure set forth therein.

TECHNICAL FIELD

The present invention relates to sports training and particularly to a rotational sports movement training and muscle conditioning harness and cord system.

BACKGROUND ART

A good golf swing or other rotational sports movement is developed through proper rotational skill movement training and muscle conditioning of the rotary motions of the body with specific emphasis on the muscles surrounding the pelvis and upper-torso for each phase of the movement. The relative sequence and timing of the coordinated upper-torso and pelvic rotary motions must be trained in proper order to develop optimal rotational skill, muscle conditioning and maximal power in the swing. Similarly, for sports that involve striking or throwing, correct rotational movement patterns, sequencing and timing must be also developed. A relatively simple system for training and conditioning for the motions of the pelvis, the upper-torso, and the arms, and the relative movement, sequencing and timing of the upper-torso and pelvis is desirable.

Belts attached to anchors have been used for swing training in sports activities such as golf and baseball. U.S. Pat. No. 3,870,317 to Wilson, U.S. Pat. Nos. 5,188,366 and 5,308,074 to Dorotinsky et al. U.S. Pat. No. 5,358,250 to Spencer, U.S. Pat. No. 5,924,933 to Pacheco, and U.S. Pat. No. 6,120,418 to Plough each disclose a golf training aid having a belt connected by an elastic cord to an anchor. U.S. Pat. No. 5,048,836 to Bellagamba discloses a hip harness connected to two elastic cords, with each cord being connected to an anchor. U.S. Pat. No. 4,544,155 to Wallenbrock et al. discloses a harness connected by an elastic cord to an anchor.

U.S. Pat. No. 1,561,960 to Ungar discloses a golf training aid with a belt attached to a rigid anchor. U.S. Pat. No. 4,593,909 to Anselmo et al. discloses a golf training aid with a rigid frame, and a pair of belt loops that connect to the frame and fit loosely around a user. The devices in these patents attempt to train correct pelvic or hip motion during a swing, but do not train a coordinated combined and sequenced upper-torso movement or the relative movement of the pelvis, torso and arms.

U.S. Pat. No. 5,050,885 to Ballard et al. discloses a golf training aid with a complex mechanical stand, a saddle rigidly connected to the stand and a vest rigidly attached to the stand. The device attempts to train hip and torso motions. The device is relatively complex and expensive, and is not readily portable.

DISCLOSURE OF THE INVENTION

A sports training and conditioning system includes an adjustable hip harness, an adjustable torso harness, two adjustable connectors, at least one elongated cord and a club band. The hip harness is shaped to fit snugly around a user's pelvis, and has a plurality of selectively positioned and oriented loops. The torso harness is shaped to fit snugly around a user's torso, and includes shoulder straps that extend over the user's shoulders. The torso harness includes a plurality of selectively positioned and oriented loops. The connectors are flexible and extend diagonally across the front of the user from the torso harness to the hip harness such that when both connectors are connected, the connectors form an X shape. One or more cords are attached at one end to a selected loop on one or both of the hip and torso harnesses and, at the other end, anchored to a stationary object or manipulated by another person. The club band is attached at one end to a selected loop on one of the hip and torso harnesses and gripped by users at the other end. The system provides swing, throw and strike training and conditioning for a multitude of rotational sports. The system provides training and conditioning for the relative movement of the pelvis, upper-torso, and arms.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
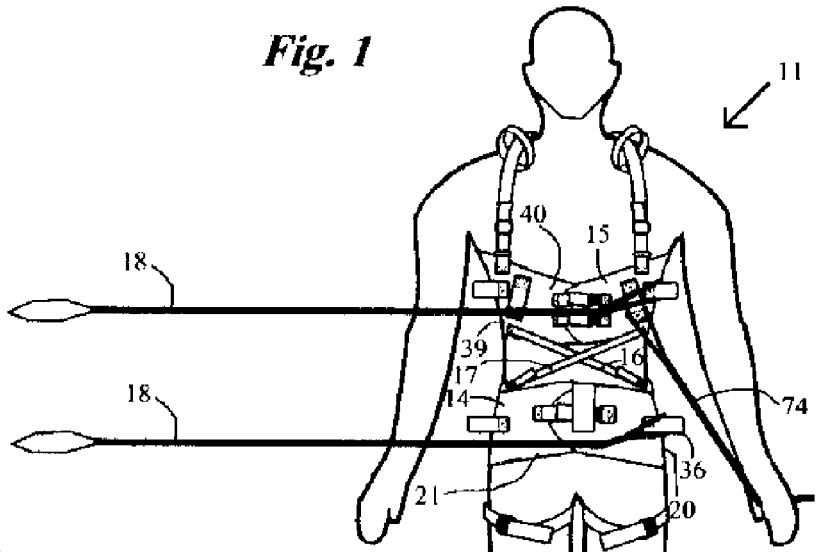
FIG. 1 is a front elevation view of a training and conditioning system embodying features of the present invention, on a user.
Figure 2:
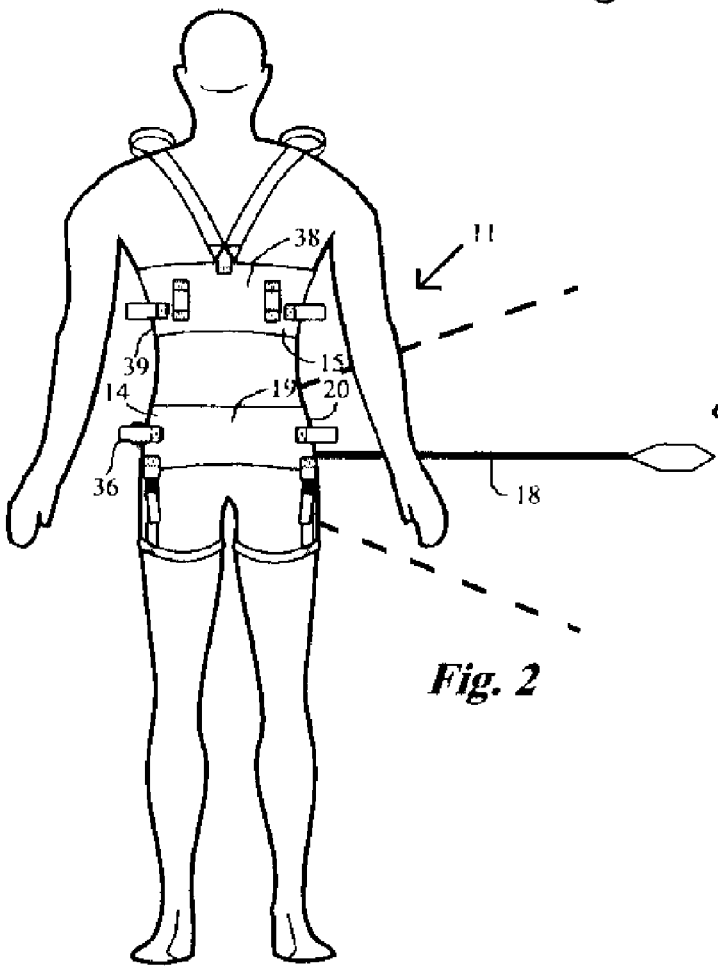
FIG. 2 is a back elevation view of the system of FIG. 1, on a user.
Figure 3:
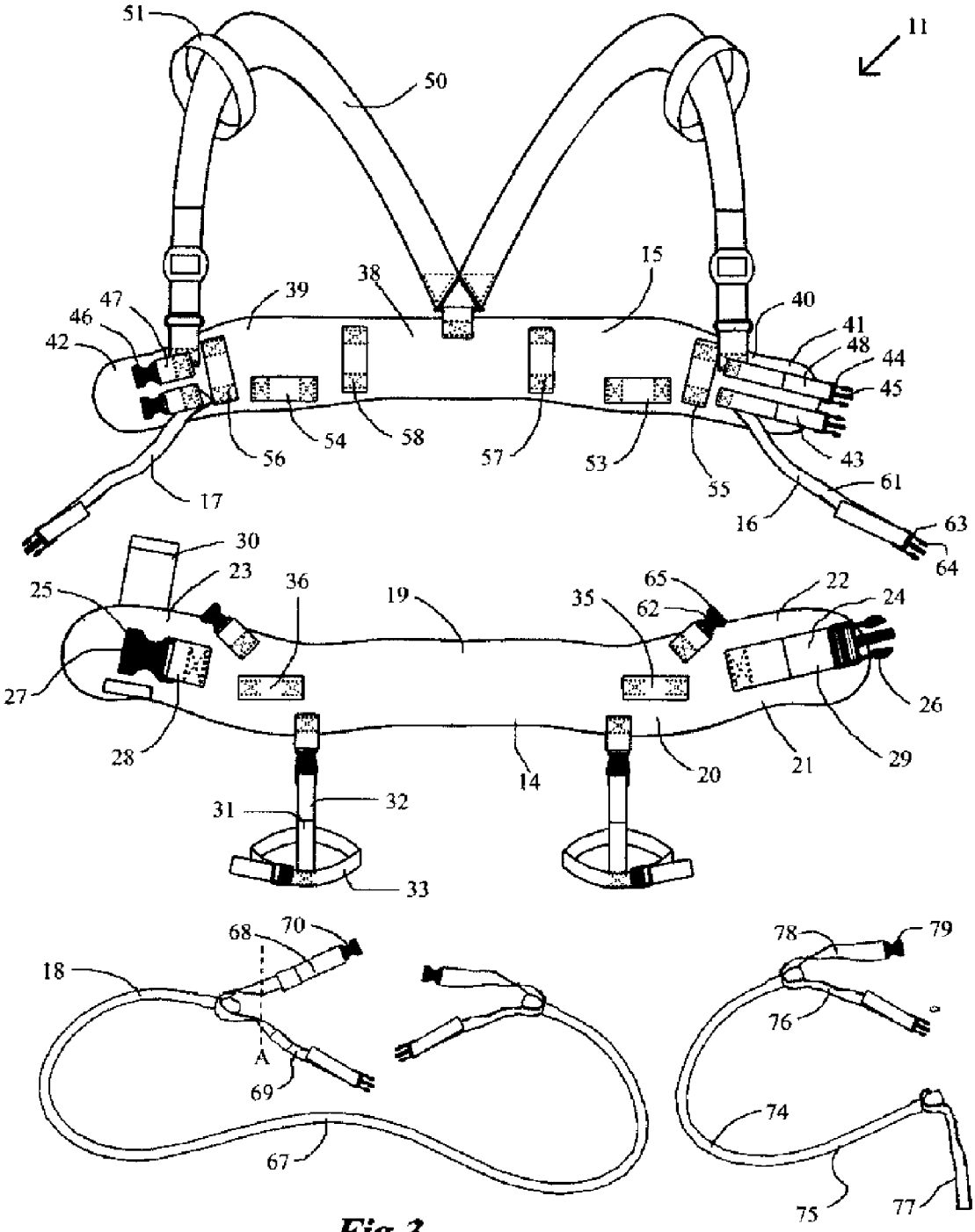
FIG. 3 is an outside flat plan view of the components of the system of FIG. 1.

Referring now to FIGS. 1, 2 and 3, a sports training and conditioning system 11 embodying features of the present invention includes a hip harness 14, a torso harness 15, first and second connectors 16 and 17, a cord 18, and a club band 74. The hip harness 14 is generally several inches wide, made of a durable, flexible material or fabric. The hip harness 14 has a foam core. The inside of the hip harness 14 is made of an anti-slip cloth to prevent rotation of the hip harness 14 relative to the user.

Describing the specific embodiments herein chosen for illustrating the invention, certain terminology is used which will be recognized as being employed for convenience and having no limiting significance. For example, the illustrated embodiment is shown in the Figures and described for a right handed user, and each configuration shown can equivalently be provided for a left handed user.

The hip harness 14 is adjustable and shaped to fit snugly around a user's pelvis. The hip harness 14 has a substantially straight hip back section 19, upwardly curving hip side sections 20 at opposite ends of the hip back section 19 and a hip front section 21 with first and second portions 22 and 23 that extend from the hip side sections 20. The first portion 22 shown will be on a user's right side and the second portion 23 on the user's left side. The hip side sections 20 are wider than the hip back and front sections 19 and 21 so that the hip harness 14 conforms to the user's pelvis.

A hip harness fastener 24 releasably connects the first and second portions 22 and 23 of the hip front section 21 and is adjustable to accommodate different user sizes. The hip harness fastener 24 is shown as a snap hip harness buckle 25. Other hip harness fasteners 24 can be used, such as hook and loop fasteners (i.e. Velcro®). Other buckle types can also be used. The hip harness buckle 25 includes a male portion 26, a female portion 27, a first hip buckle strap 28 and a second hip buckle strap 29. The male portion 26 releasably snaps into the female portion 27. The first hip buckle strap 28 is sewn to the second portion 23 of the hip front section 21 and the female portion 27. The second hip buckle strap 29 is sewn at one end to the first portion 22 of the hip front section 21 and at the other end is adjustably secured to the male portion 26. A buckle cover 30 folds over and covers the hip harness buckle 25.

A pair of thigh loops 31 each have a thigh connector strap 32 and a thigh cuff strap 33. The thigh connector straps 32 releasably attach to opposite ends of the back hip section 19. The thigh cuff straps 33 each connect transversely to a thigh connector strap 32, are adjustable and each wrap around a user's thigh. The thigh loops 31 prevent the hip harness 14 from moving upwardly on a user's body and provide the user with a tactile feel for proper rotational muscle stretch or load. A first cord loop 35 is a horizontal strap attached at opposite ends to one of the hip side sections 20 and a second cord loop 36 is a horizontal strap attached at opposite ends to the other hip side section 20. The first and second cord loops 35 and 36 can be coded such as by being different colors. The first cord loop 35 is on the user's right and second cord loop 36 shown is on the user's left. By way of example, and not as a limitation, the first cord loop 35 can be orange, and the second cord loop 36 can be blue.

The torso harness 15 is generally several inches wide, and made of a durable, flexible material or fabric with a foam core and an anti-slip cloth on the inside. The torso harness 15 has a substantially straight torso back section 38, downwardly curving torso side sections 39 at opposite ends of the torso back section 38 and a torso front section 40 with first and second portions 41 and 42 that extend from the torso side sections 39. The first portion 41 shown will be on a user's right side and the second portion 42 on the user's left side. The torso side sections 39 are wider than the torso back and front sections 38 and 40 so that the torso harness 15 conforms to the user's torso.

A torso harness fastener 43 releasably connects the first and second portions 41 and 42 of the front torso section 40 and is adjustable to accommodate different user sizes. The torso harness fastener 43 is shown as a pair of spaced snap torso harness buckle 44. Other torso harness fasteners 43 can be used, such as hook and loop fasteners (i.e. Velcro®). Other buckle types can also be used. The torso harness buckles 44 each include a male portion 45, a female portion 46, a first torso buckle strap 47 and a second torso buckle strap 48. The male portions 45 releasably snap into the female portions 46. The first torso buckle straps 47 are sewn to the second portion 42 of the torso front section 40 and the female portions 46. The second torso buckle straps 48 are sewn at one end to the first portion 41 of the torso front section 40 and at the other end is adjustably secured to the male portion 45.

A pair of adjustable shoulder straps 50 each attach at one end to the middle of the back torso section 38 and extend upwardly therefrom. The other ends of the shoulder straps 50 each attach to one of the torso front sections 40. The shoulder straps 50 prevent the torso harness 15 from moving downwardly on a user's body. A circular shoulder strap guide loop 51 encircles each shoulder strap 50.

The torso harness 15 includes a first cord 53 loop, a second cord loop 54, a third cord loop 55, a fourth cord loop 56, a fifth cord loop 57 and a sixth cord loop 58. Each of the first, second, third, fourth, fifth and sixth cord loops 53, 54, 55, 56, 57 and 58 are straps with opposite ends attached to the outside of the torso harness 15.

The first cord loop 53 is horizontal and attached to one of the side torso sections 39. The second cord loop 54 is horizontal and attached to the other side torso section 39. The third cord loop 55 is substantially vertical and attached to the first portion 41 of the front torso section 40, adjacent to the first cord loop 53. The fourth cord loop 56 is substantially vertical and attached to the second portion 42 of the front torso section 40, adjacent to the second cord loop 54. The fifth and sixth cord loops 57 and 58 are vertical and attached at opposite ends of the back torso section 38, adjacent to the first and second cord loops 53 and 54.

The first, second, third, fourth, fifth and sixth cord loops 53, 54, 55, 56, 57 and 58 can be coded such as color coded. The first, third and fifth cord loops 53, 55 and 57 shown are on the user's right. The second, fourth and sixth cord loops 54, 56 and 58 are on the user's left. By way of example, and not as a limitation, the first cord loop 53 can be orange, the second cord loop 54 can be blue, the third cord loop 55 can be tan, the fourth cord loop 56 can be black, the fifth cord loop 57 can be yellow and the sixth cord loop 58 can be green.

The first and second connectors 16 and 17 are flexible and adjustable, and releasably connect the hip harness 14 to the torso harness 15. Each of the first and second connectors 16 and 17 has a strap 61 and a fastener 62. The strap 61 can be elastic or inelastic. The strap 61 is attached to and extends downwardly from the front torso section 40 of the torso harness 15. The fastener 62 shown is a snap buckle 63 having a male portion 64 and a female portion 65. Other fasteners or buckle types can be used. The male portion 64 is adjustably attached to the strap 61. The female portion 65 is attached to the hip front section 21 and is upwardly open.

As shown in FIG. 1, the first connector 16 preferably connects diagonally from the first portion 41 of the torso front section 40 to second portion 23 of the hip front section 21. The second connector 17 preferably connects diagonally from the second portion 42 of the torso front section 40 to the first portion 22 of the hip front section 21. When the first and second connectors 16 and 17 are both connected, the first and second connectors 16 and 17 form an X across the front of the user between the hip harness 14 and the torso harness 15. The first and second connectors 16 and 17 can extend vertically between the torso harness 15 and the hip harness 14.

The cord 18 shown includes a resilient elongated portion 67 with a cord fastener 68 at each end of the elongated portion 67. Each cord fastener 68 has a cord strap 69 attached to an end of the elongated portion 67 and a buckle 70 that releasably connects the ends of the cord strap 69. The elongated portion 67 can be rubber tubing, bungee cord, shock cord, or other stretchy cord, band or rope. The elongated portion 67 can also be inelastic.

The club band 74 has a elongated portion 75 with a band fastener 76 at one end and a hand strap 77 at the other end. The band fastener 76 has a band strap 78 attached to an end of the elongated portion 75 and a buckle 79 that releasably connects the ends of the band strap 78. The elongated portion 75 can be rubber tubing, bungee cord, shock cord, or other stretchy cord, band or rope. The elongated portion 75 can also be inelastic.

The first connector 16 shown synchronizes the rotation of the user's upper torso with the counter-clockwise rotation of the user's pelvis. At the beginning of a golf down-swing the user's pelvis starts to rotate counter-clockwise first with the upper torso stationary and the muscles connecting the pelvis to the upper torso stretching. The first connector 16 is adjusted so that, as the pelvis rotates, at the proper time, the first connector 16 tightens and the upper torso starts to rotate counter-clockwise. Repetition of the swing develops proper sequencing, timing and conditions the muscles to repeatably perform this movement without using the system.

The second connector 17 shown synchronizes the rotation of the user's upper torso with the clockwise rotation of the user's pelvis. The second connector 17 is used to develop proper sequencing, timing and to condition the muscles for the preparation or loading phase of the fore-hand swing in sports such as tennis or the backswing in sports such as golf.

Figure 4:
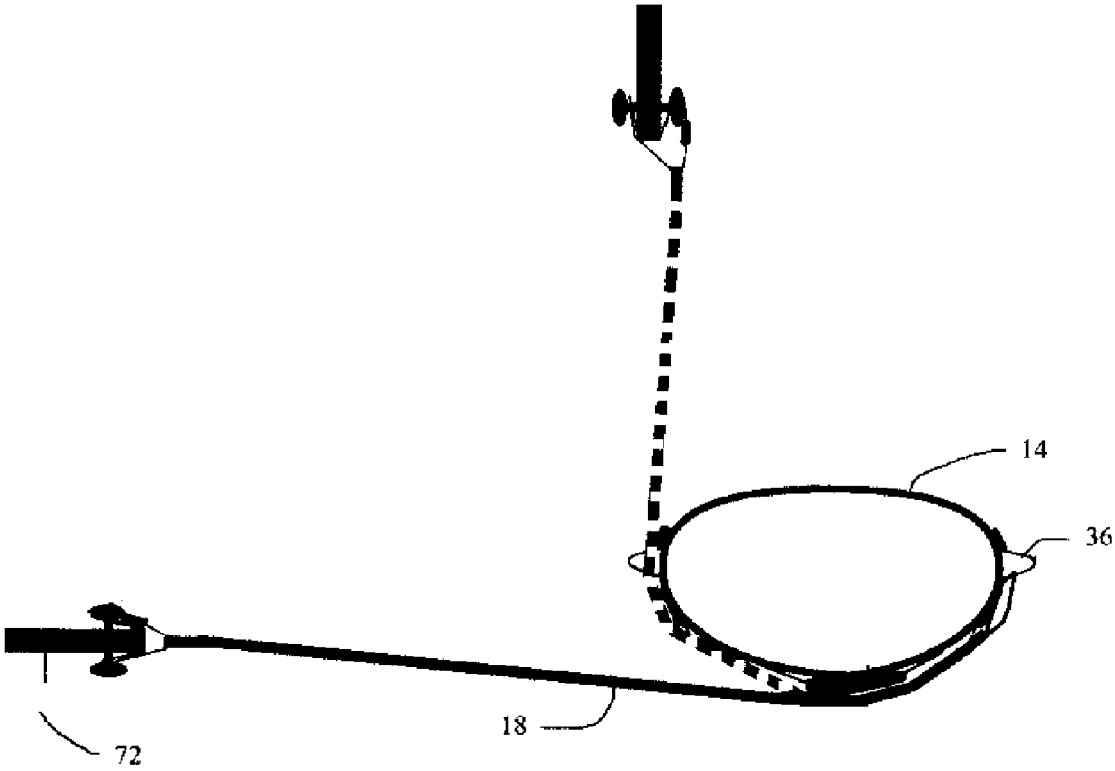
FIG. 4 is a schematic top plan view of the hip harness and cord of the system of FIG. 1, on a user.

One of the cord fasteners 68 on the cord 18 attaches to one of the first and second cord loops 35 and 36 on the hip harness 14 or one of the first, second, third, fourth, fifth and sixth cord loops 53, 54, 55, 56, 57 and 58 on the torso harness 15. The other cord fastener 68 on the cord 18 attaches to an anchor, such as a door, or is held by a trainer. For backswing training and conditioning, as shown in FIGS. 1, 2 and 4, a resilient cord 18 is attached to the second cord loop 36, on the user's left side, on the hip harness 14. The user stands with the cord 18 extending across the user's front and to the user's right, back or other various angles of pull to an anchor 72. Where the anchor 72 is a door with doorknobs, the cord strap 69 can be looped around one or both doorknobs. The cord strap 69 can also be placed, at the dotted line A shown in FIG. 3, between the door and the frame at any elevation, and the door can then be closed to anchor the cord 18. In an alternative to the cord, a cable type strength training machine or other forms of resistance strength training equipment may be attached to either harness. Also the above described interconnected harness may be used without either cord.

The cord 18 is stretched so that the cord 18 rotates the body clockwise and rotates the pelvis over the right hip joint, stretching various muscles of the thighs, hips, pelvis, spine and the gluteal muscles of both the right and left hip joints. The stretch of these muscles, especially the gluteal muscles, stimulates the various stretch and positional receptors in the muscles and the hip joints. This stimulation develops the feel of a proper golf backswing via the development of muscle memory as well as activating specific muscles to increase the ability of these muscles to contract to effectively perform the specific rotational sports motion or movement. This action when performed following a specific program of load, frequency, repetitions, sets, recovery and rest etc, can increase the strength, endurance, speed, power and flexibility of the muscles specific to a proper golf swing or rotational sports movement.

Specific types of physical training responses can be elicited depending on the training program design. The program variables can be formulated to simply warm-up or activate the muscles of the rotational sports movement or to increase the velocity or speed or the muscle contractions, the resulting pelvic rotation increasing club head and ultimately leading to increased ball velocity and ball distance. The cord 18 can also be held at various different angles of pull and manipulated by a trainer and an inelastic cord 18 can be used. The cord 18 can extend rearwardly from the user instead of to the user's right, as shown in dashed line in FIG. 4. In this configuration, when used for backswing training, the cord 18 provides assistance to the user. This configuration can also be used for swing training with the cord 18 providing downswing resistance to the user. Similarly, for each of the configuration described hereinafter, the cord 18 can provide assistance or resistance.

The club band 74 teaches the feel for proper arm positioning and forearm rotation that should occur from address into the backswing and then through the downswing, impact, follow-thru and finish positions in a golf swing. The user attaches the band fastener 76 of the club band 74 to one of the first, second, third, fourth, fifth and sixth cord loops 53, 54, 55, 56, 57 and 58 on the torso harness 15. The hand strap 77 is held by the user. The user can either perform the swing turn with or without holding a golf club. The use of the club band serves as the basis for other rotational sports where the arms/hands also need to be synchronized to the turn of the pelvis and upper-torso.

Figure 5:
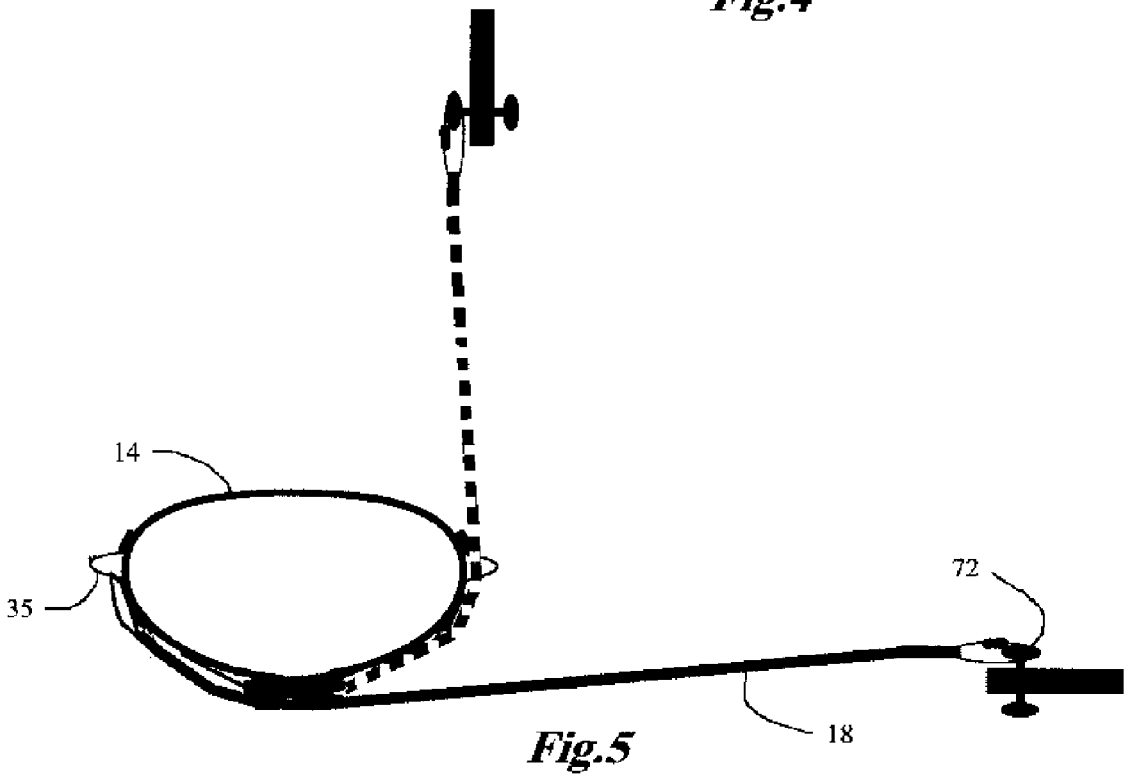
FIG. 5 is a schematic top plan view of the hip harness and cord of the system of FIG. 1, with another configuration.
Figure 6:
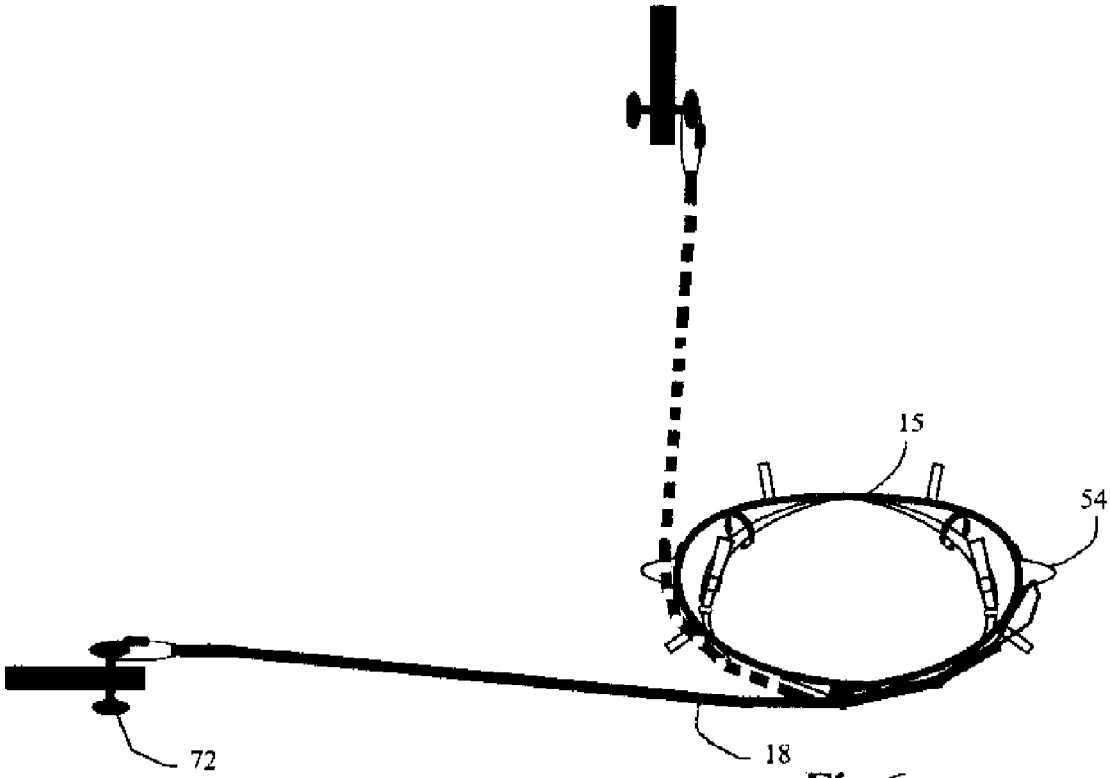
FIG. 6 is a schematic top plan view of the torso harness and cord of the system of FIG. 1, with another configuration.
Figure 7:
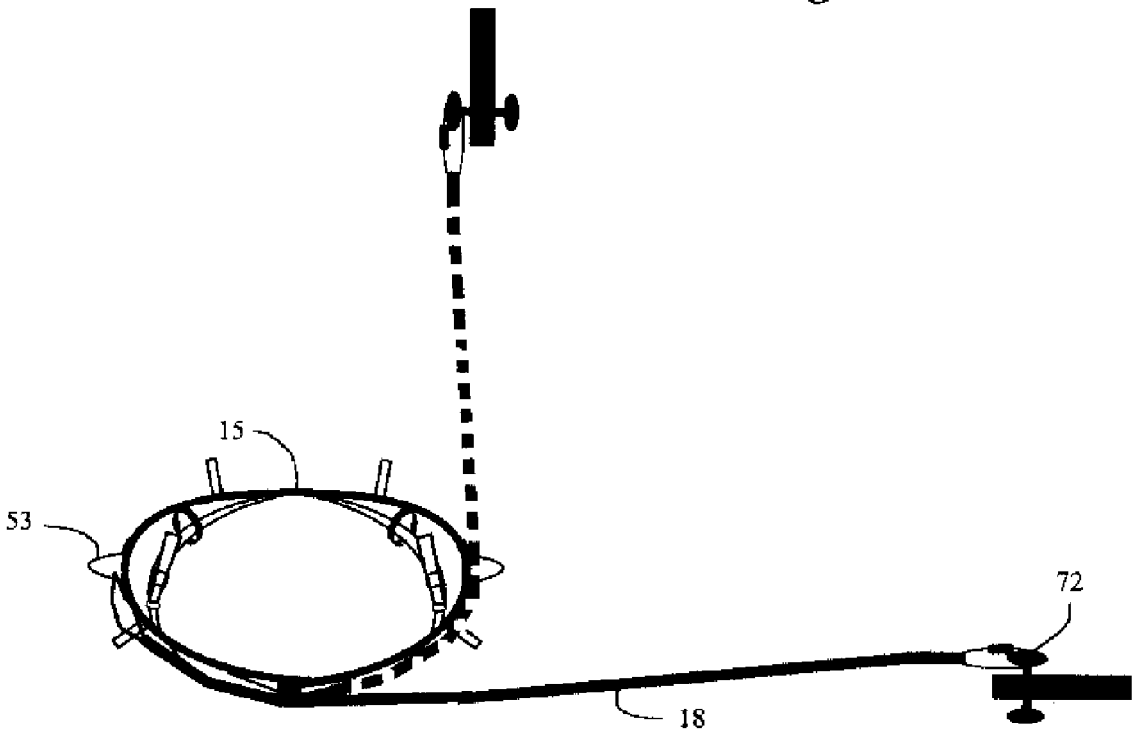
FIG. 7 is a schematic top plan view of the torso harness and cord of the system of FIG. 1, with another configuration.

For swing training and conditioning, as shown in FIG. 5, the cord 18 is attached to the first cord loop 35, on the user's right side, on the hip harness 14. The user stands with the cord 18 extending across the user's front and to the user's left to an anchor 72. FIG. 6 shows the cord 18 attached to the second cord loop 54 on the torso harness 15, and extending across the user's front and to the user's right, for backswing training and conditioning, such as a golf backswing. FIG. 7 shows the cord 18 attached to the first cord loop 53 on the torso harness 15, and extending across the user's front and to the user's left, for swing training and conditioning, such as a golf backswing or downswing.

For each of the configurations shown in FIGS. 1, 2 and 4-7, the cord 18 can extend horizontally from the user or can extend at any angle up or down from the user, as shown by the dashed lines in FIG. 2. For each of these configurations, a second cord 18 can be attached to the other of the hip or torso harness 14 or 15, as shown in FIG. 1. Other configurations in which the cord 18 is attached to any one of the first and second cord loops 35 and 36 on the hip harness 14 or any one of the first, second, third, fourth, fifth and sixth cord loops 53, 54, 55, 56, 57 and 58 on the torso harness 15 can be used.

Figure 8:
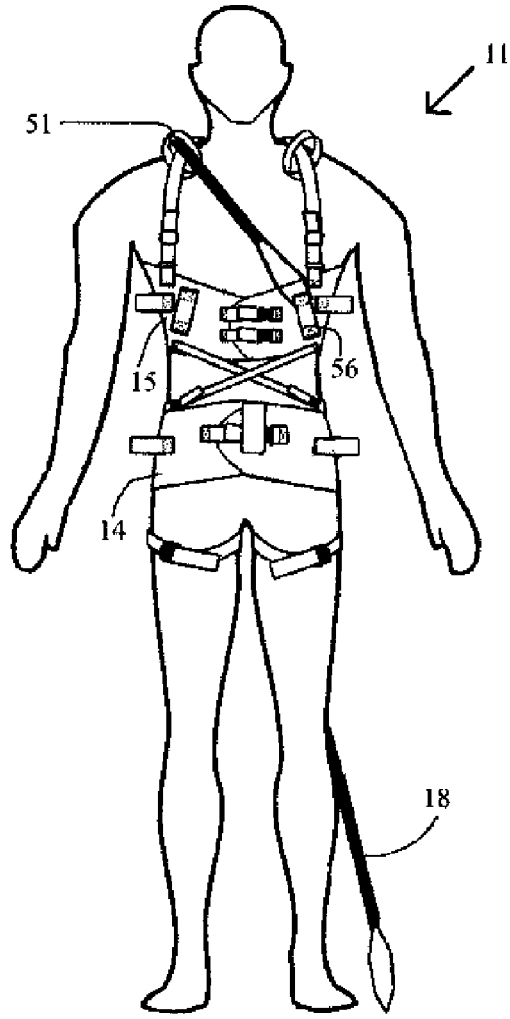
FIG. 8 is a front elevation view of the system of FIG. 1, with another configuration.
Figure 9:
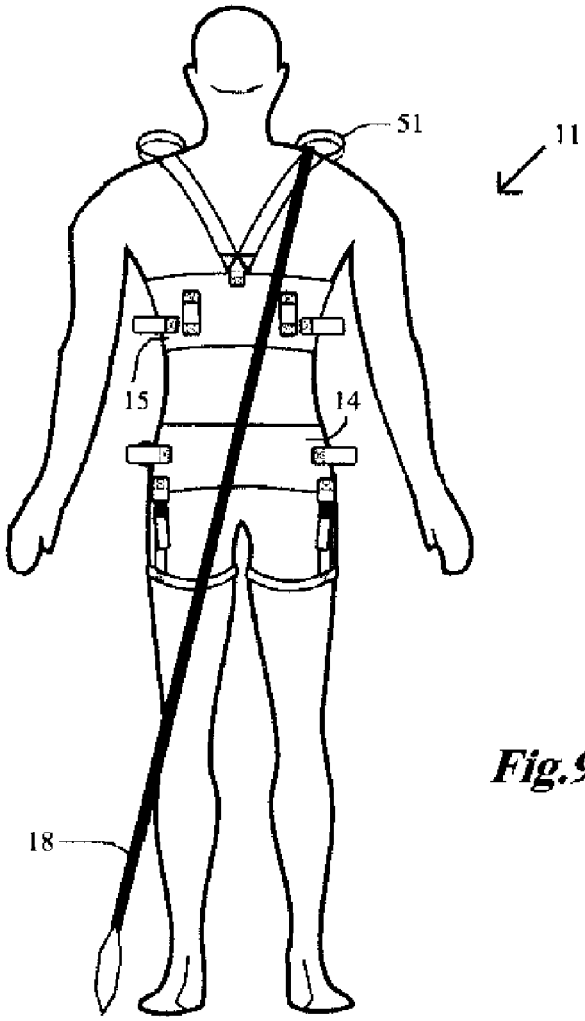
FIG. 9 is a back elevation view of the system of FIG. 1, with the configuration of FIG. 8.

FIGS. 8 and 9 show the sports training and conditioning system 11 configured for volleyball training and conditioning with the cord 18 attached to the fourth cord loop 56 on the torso harness 15. The cord 18 runs from the fourth cord loop 56 upwardly and rightwardly through the shoulder strap guide loop 51, over the user's right shoulder, and downwardly and leftwardly towards the user's left heel.

Figure 10:
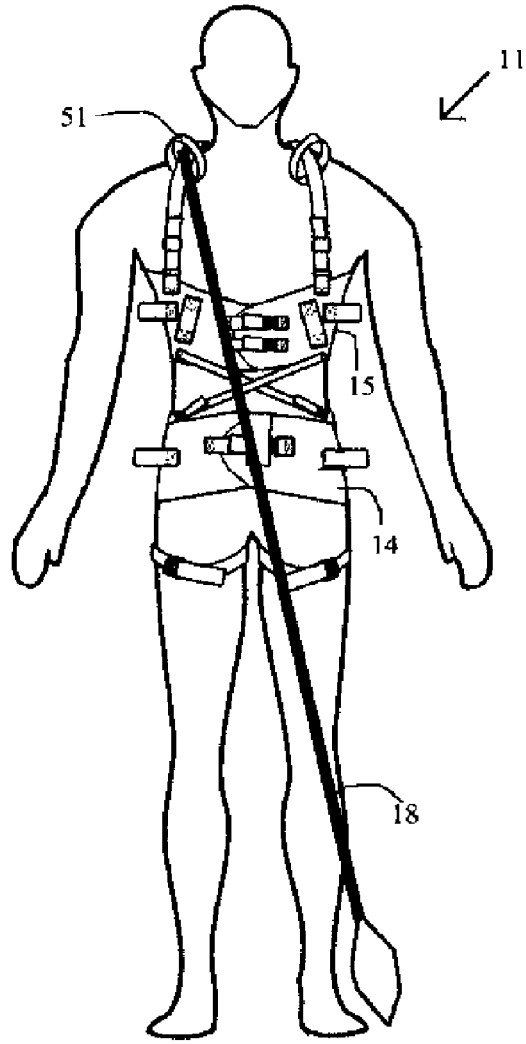
FIG. 10 is a front elevation view of the system of FIG. 1, with another configuration.
Figure 11:
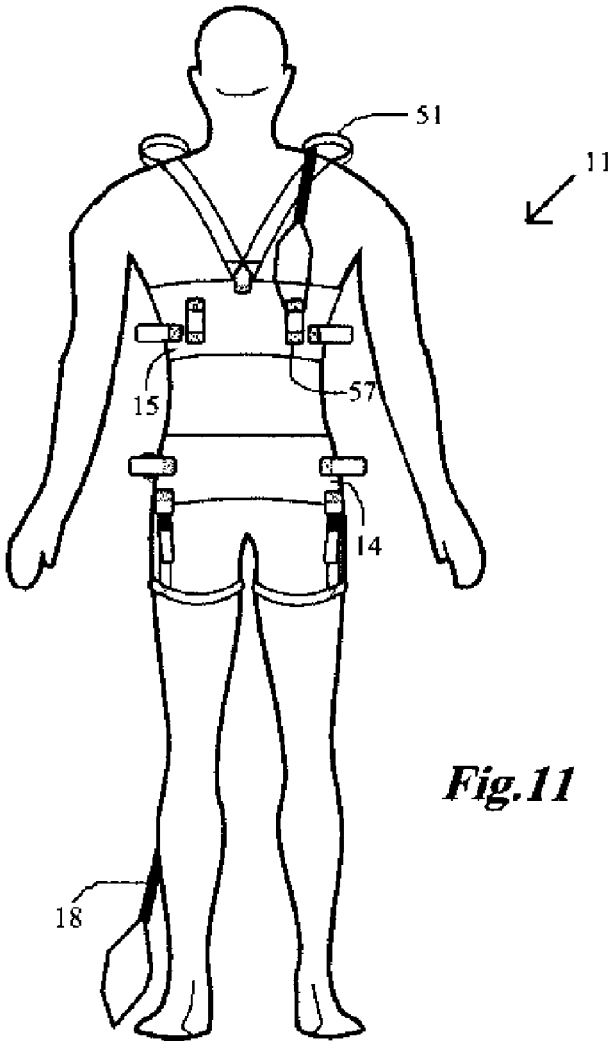
FIG. 11 is a back elevation view of the system of FIG. 1, with the configuration of FIG. 8.

FIGS. 10 and 11 show the sports training and conditioning system 11 in another configuration for volleyball training and conditioning with the cord 18 attached to the fifth cord loop 57 on the torso harness 15. The cord 18 runs from the fifth cord loop 57 upwardly over the user's right shoulder, downwardly through the shoulder strap guide loop 51, and downwardly and leftwardly towards the user's left toes. The configurations of FIGS. 8 to 11 are for training and conditioning for a right handed serve or spike. The third and sixth cord loops 55 and 58, respectively, are used for training and conditioning for a left handed serve or spike.

For each of the configurations shown in FIGS. 8-11, the cord 18 can extend over the user's shoulder and through strap guide loop 51 or can extend horizontally from the user or can extend at any angle up or down from the user. For each of these configurations, a second cord 18 can be attached to the other of the hip or torso harness 14 or 15. Other configurations in which the cord 18 is attached to any one of the first and second cord loops 35 and 36 on the hip harness 14 or any one of the first, second, third, fourth, fifth and sixth cord loops 53, 54, 55, 56, 57 and 58 on the torso harness 15 can be used.

The system 11 is used for training and conditioning for golf and volleyball. The system 11 can also be used for skill training and conditioning for tennis, baseball, softball, lacrosse, hockey, and track and field events such as shot-put, discus, hammer and javelin. The cord 18 provides assistance in one direction and resistance in the opposite direction, for development of muscle memory and muscle conditioning. The system 11 can also be used for muscular skeletal rehabilitation of the spine, pelvis and hips.

Although the present invention has been described with a certain degree of particularity, it is understood that the present disclosure has been made by way of example and that changes in details of structure may be made without departing from the spirit thereof.

What is claimed is:

1. A sports training system for training rotational motions of and neuro-muscular conditioning a user, comprising:

a hip harness for attachment to the pelvis of said user, said hip harness having a hip back section and a hip side section at opposite ends of said hip back section, a pair of horizontal hip cord loops connected to and extending out from said hip side sections away from the opposite sides of said user to which horizontal external forces are applied during use, a torso harness for attachment to the torso of said user, said torso harness having a torso back section and a torso side section at opposite ends of said torso back section, a pair of horizontal torso cord loops connected to and extending out from said torso side sections away from the opposite sides of said user to which horizontal external forces are applied during use, and an inelastic, adjustable first connector that extends diagonally from said torso harness to said hip harness, said first connector being adjustable in length to be slack when the pelvis and upper torso of said user are rotationally aligned and to allow free relative rotation between the pelvis and upper torso of said user about a selected first angle in a first direction, and to become taut and prevent relative rotation between the pelvis and upper torso of said user beyond said first angle in said first direction, whereby said first connector synchronizes rotation between the upper torso and pelvis of said user in said first direction for development of muscle memory so that the user may repeatedly perform the same movement.

2. The system as set forth in claim 1 including an inelastic, adjustable second connector diagonally connected from said torso harness to said hip harness transverse to said first connector, said second connector being adjustable to be slack when the pelvis and upper torso of said user are rotationally aligned and allow free relative rotation between the pelvis and upper torso of said user about a selected second angle in an opposite second direction, and to become taut and prevent relative rotation between the pelvis and upper torso of said user beyond said second angle in said second direction, whereby said first and second connectors synchronize relative rotation between the upper torso and pelvis of said user in said first and second directions.

3. The system as set forth in claim 1 wherein said first connector connects across the front of said user.

4. The system as set forth in claim 1 wherein said hip harness includes a pair of thigh loops sized and shaped to fit around said user's thighs and said torso harness includes a pair of shoulder straps sized and shaped to fit over said user's shoulders, whereby said thigh loops prevent said hip harness from moving upwardly and said shoulder straps prevent said torso harness from moving downwardly as said first connector synchronizes rotation of the upper torso relative to the pelvis of said user.

5. The system as set forth in claim 1 wherein said hip harness has a hip front section, said torso harness has a torso front section, and said first connector connects from said torso front section to said hip front section.

6. The system as set forth in claim 1 including an elongated cord releasably attachable to one of said torso and hip cord loops, whereby said cord provides resistance when said user moves against said cord and said cord provides assistance when said user moves with said cord.

7. The system as set forth in claim 6 wherein said cord includes an elongated portion with spaced ends and a releasable cord fastener at each end of said elongated portion.

8. The system as set forth in claim 7 wherein said hip harness includes a plurality of selectively positioned cord loops that are sized, shaped and oriented to receive one of said cord fasteners on said cord.

9. The system as set forth in claim 7 wherein said torso harness includes a torso front section connected to said torso side sections, and a plurality of selectively positioned cord loops that are sized, shaped and oriented to receive one of said cord fasteners on said cord.

10. The system as set forth in claim 9 wherein said torso harness includes a spaced pair of said cord loops attached to said torso back section.

11. The system as forth in claim 9 wherein said torso harness includes a spaced pair of said cord loops attached to said torso front section.

12. The system as set forth in claim 9 wherein said torso harness includes a pair of shoulder straps and each said shoulder strap includes a shoulder strap guide loop for guiding said cord over the shoulder of said user when said cord is attached to said torso harness.

13. The system as set forth in claim 9 including a resilient elongated club band attached at one end to one of said cord loops on said torso harness, whereby said user grips the other end of said club band while practicing a swing.

14. A sports training system for training rotational motions of and neuro-muscular conditioning a user, comprising:

a hip harness for attachment to the pelvis of said user, said hip harness having a hip back section and a hip side section at opposite ends of said hip back section, a pair of horizontal hip cord loops connected to and extending out from said hip side sections away from the opposite sides of said user to which horizontal external forces are applied during use, a spaced torso harness for attachment to the torso of said user, said torso harness having a pair of horizontal torso cord loops connected to and extending out from said torso side sections away from the opposite sides of said user to which horizontal external forces are applied during use, an inelastic, adjustable first connector that extends diagonally from said torso harness to said hip harness, said first connector being adjustable in length to be slack when the pelvis and upper torso of said user are rotationally aligned and to allow free relative rotation between the pelvis and upper torso of said user about a selected first angle in a first direction, and to become taut and prevent relative rotation between the pelvis and upper torso of said user beyond said first angle in said first direction, an inelastic, adjustable second connector that extends diagonally from said torso harness to said hip harness transverse to said first connector, said second connector being adjustable in length to be slack when the pelvis and upper torso of said user are rotationally aligned and allow free relative rotation between the pelvis and upper torso of said user about a selected second angle in an opposite second direction, and to become taut and prevent relative rotation between the pelvis and upper torso of said user beyond said second angle in said second direction, and an elongated cord releasably attachable to one of said cord loops on one of said hip harness and said torso harness, whereby said first and second connectors are adjusted to selectively synchronize rotation between said user's upper torso and said user's pelvis for development of muscle memory so that the user may repeatedly perform the same movement.

* * * * *